US005613775A

United States Patent [19]

Neri

[11] Patent Number: 5,613,775

[45] Date of Patent: Mar. 25, 1997

[54] APPARATUS FOR MIXING LIQUID PRODUCTS TO PREPARE COLORING SUBSTANCES FOR PAINTS AND THE LIKE

[75] Inventor: Giuseppe Neri, Cinisello Balsano, Italy

[73] Assignee: Fast S.p.A., Cinisello Balsano, Italy

[21] Appl. No.: 503,388

[22] Filed: Jul. 17, 1995

[30] Foreign Application Priority Data

Jul. 21, 1994 [IT] Italy ..... MI94A01547

[51] Int. Cl.[6] ..... B01F 7/16

[52] U.S. Cl. ..... 366/297; 366/331; 366/605; 366/314

[58] Field of Search ..... 366/605, 279, 366/298, 297, 314, 205, 241, 14, 15, 292, 331

[56] References Cited

U.S. PATENT DOCUMENTS 2,923,438 2/1960 Logan ..... 366/605
4,225,248 9/1980 Para ..... 366/605
4,792,236 12/1988 Heinis ..... 366/605
4,953,985 9/1990 Miller ..... 366/605

*Primary Examiner*—Robert W. Jenkins
*Attorney, Agent, or Firm*—Bucknam and Archer

[57] ABSTRACT

The present invention relates to an apparatus for mixing liquid products, in particular to prepare coloring substances for paints and the like. The apparatus includes a base supporting a substantially horizontal table with supports, on the top face thereof, a plurality of vessels for the liquid products to be mixed. Inside each vessel is applied a stirring element which projects by its driving end portion from the vessel. The apparatus further includes a coupling element for coupling the driving end portions of the stirring elements to a driving device which can be actuated to simultaneously drive the stirring elements.

8 Claims, 2 Drawing Sheets

APPARATUS FOR MIXING LIQUID PRODUCTS TO PREPARE COLORING SUBSTANCES FOR PAINTS AND THE LIKE

BACKGROUND OF THE INVENTION

The present invention relates to an apparatus for mixing liquid products, in particular to prepare coloring substances for paints and the like.

As is known, one of the most important operations for preparing coloring substances for paints or the like, is that of properly mixing the coloring substances.

In order to perform this operation, there are used at present mixing apparatus including stirring elements, arranged inside the vessels into which is introduced the coloring substance to be mixed.

These prior apparatus have the drawback that they subject the coloring substances to a comparatively strong stirring force, thereby altering the pigment or dye materials of the coloring substances.

This problem is very important in this field since, a possible alteration of the coloring substances can cause a consequent alteration of the color hue and/or a quick degradation of the coloring substance.

SUMMARY OF THE INVENTION

Accordingly, the aim of the present invention is to overcome the above mentioned problem, by providing an apparatus for mixing liquid products, in particular coloring substances for paints or the like, which does not cause any alteration of the pigment or dye materials contained in these products.

Within the scope of the above-mentioned object, a main object of the present invention is to provide such a mixing apparatus suitable for simultaneously mixing several coloring substances contained in different related vessels, so as to assure a very homogeneous mixing of the contents of the mentioned vessels.

Another object of the present invention is to provide such a mixing apparatus which is comparatively simple construction-wise and which, moreover, is very competitive with respect to prior like commercially available apparatus.

Yet another object of the present invention is to provide such a mixing apparatus which is very safe and reliable in operation.

According to one aspect of the present invention, the above mentioned aim and objects, as well as yet other objects, which will become more apparent hereinafter, are achieved by a mixing apparatus for mixing liquid products, in particular for preparing coloring substances for paints and the like, characterized in that said apparatus comprises a base supporting a substantially horizontal table, which supports, on a top face thereof, a plurality of vessels for the liquid products to be mixed, inside each said vessel a stirring element being arranged, which project, by a driving end portion thereof, from said vessel, a coupling element being moreover provided for coupling all of the driving end portions of said stirring elements to driving means which can be controllably actuated to drive said stirring elements.

BRIEF DESCRIPTION OF THE DRAWINGS

Further characteristics and advantages of the present invention will become more apparent hereinafter from the following detailed disclosure of a preferred, though not exclusive, embodiment of the apparatus according to the invention which is illustrated, by way of an indicative, but not limitative, example, in the figures of the accompanying drawings, where.

DESCRIPTION OF THE PREFERRED EMBODIMENT

Figure 1:
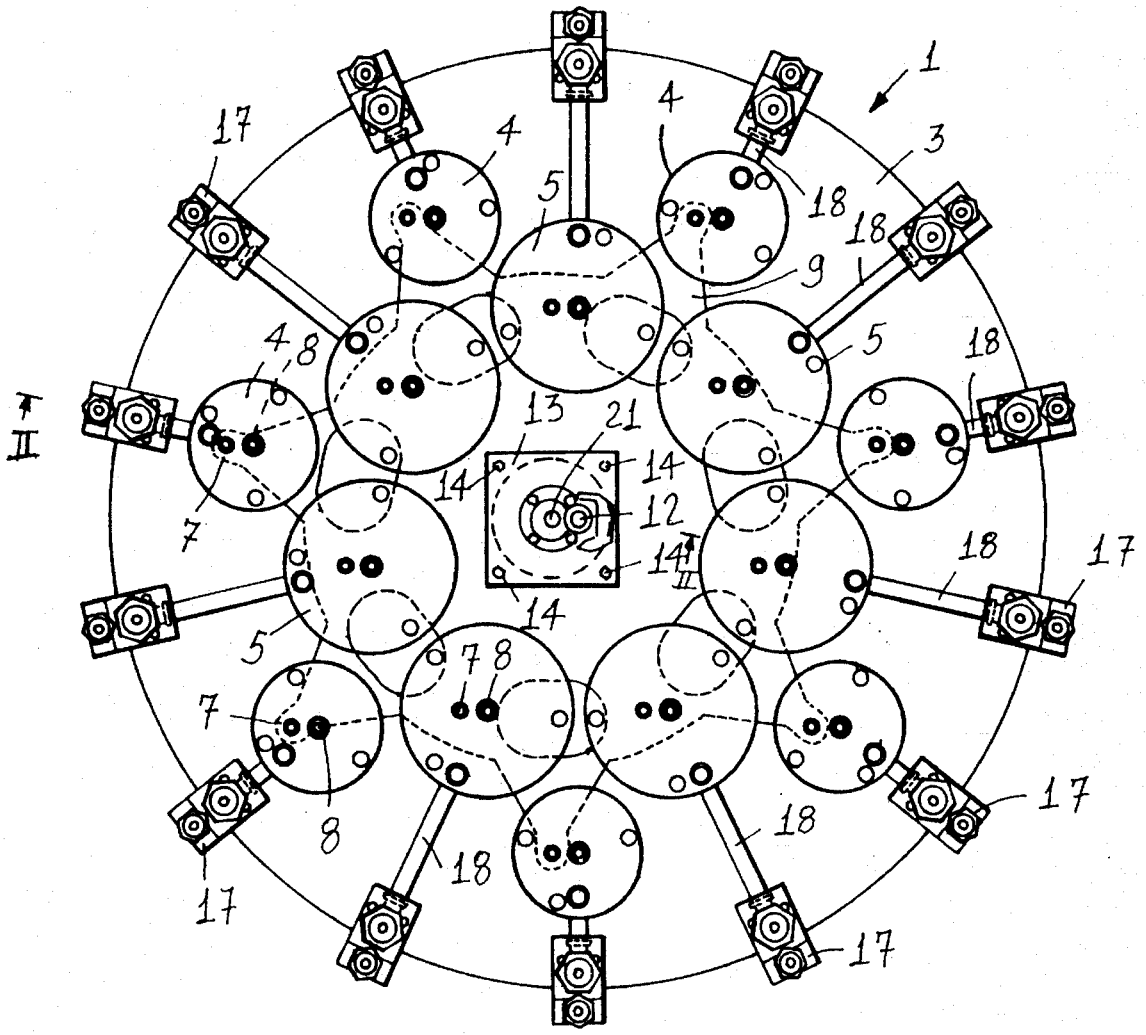
FIG. 1 is a schematic top plan view of the apparatus according to the present invention.
Figure 2:
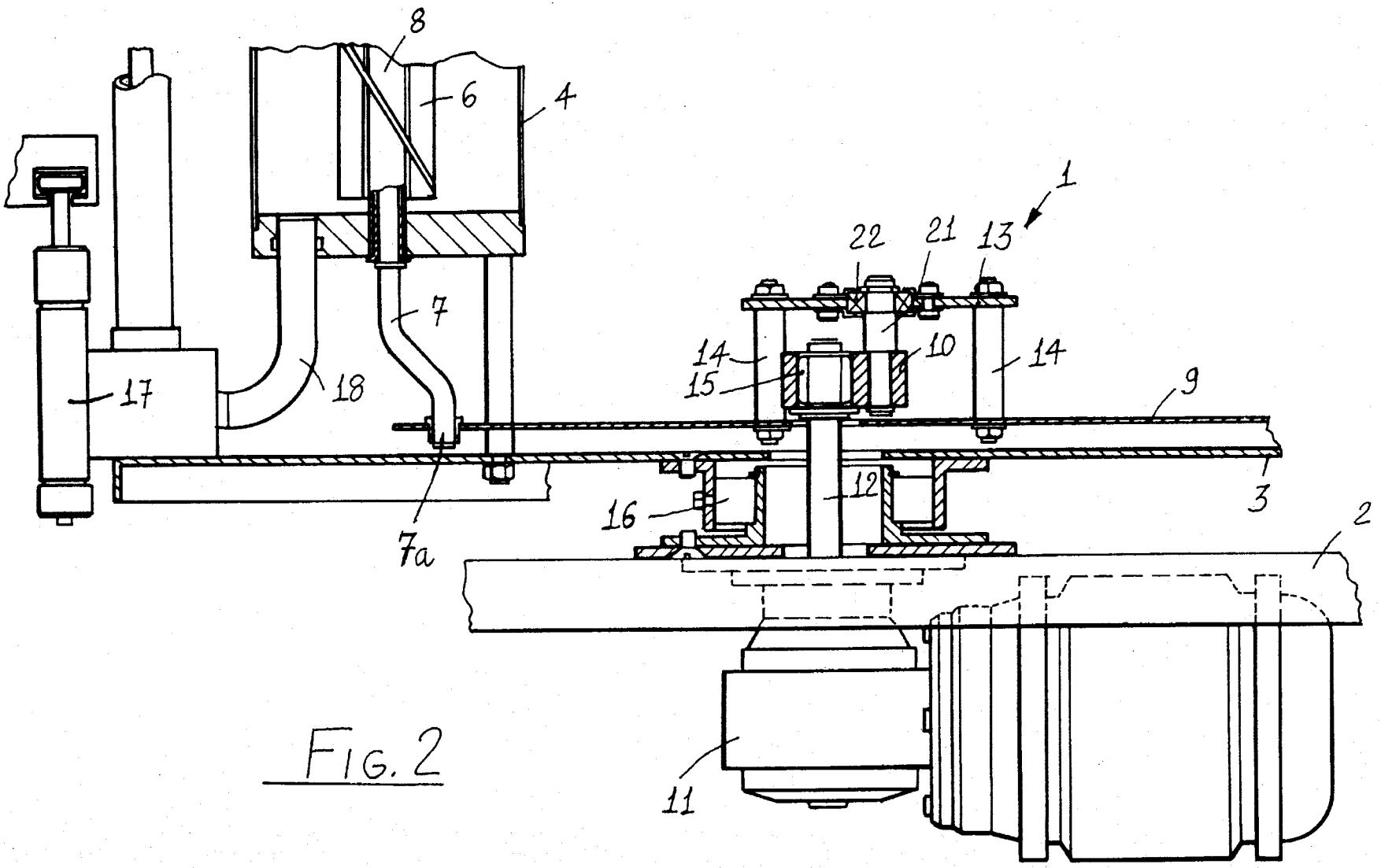
FIG. 2 is an enlarged cross sectional view of the apparatus according to the present invention substantially taken along the section line II—II of FIG. 1.

With reference to the number references of the above mentioned figures, the mixing apparatus according to the present invention, which has been generally indicated by the reference number 1, comprises an apparatus base or framework 2, supporting a substantially horizontal table 3 and which, in turn, supports, on the top face or surface thereof, a plurality of vessels 4, 5, having preferably a substantially cylindrical configuration and vertical axis, provided for holding therein liquid products to be mixed.

Inside each vessel 4, 5 is arranged a stirring element 6 which projects, by a driving end portion 7 thereof, from the bottom of the related vessel and which is coupled, by a coupling element 9, to driving means, which can be controllably actuated in order to drive the several stirring elements 6 arranged in their respective vessels 4, 5.

More specifically, each stirring element 6 comprises a blade which is connected to a shaft 8 which is rotatably supported about its rotation axis which substantially coincides with the axis of the vessel in which it is arranged.

The bottom end portion of the shaft 8 projects at the bottom from the related vessel 4, 5 and comprises a crankshaft 7.

The free end portion 7*a* of each crankshaft 7, which is substantially parallel to and spaced from that portion of the shaft 8 which extends inside the vessel 4, 5, is pivoted to the coupling element 9.

The latter is suitably constituted by a star connecting rod, which is turned toward the top surface of the table 3 and being coupled to the driving means by a crank 10 which can turn about an axis spaced from the center of the star connecting rod.

The driving means preferably comprise an electric motor-reducing unit 11, which is supported from the inside of the base 2 and has the vertical output shaft 12 thereof which is connected to the crank 10 which, in turn, is connected, by a pin 21, parallel to and spaced from the shaft 12 to the connecting rod 9, by the interposition of a bearing 22.

As shown, for size considerations, the pin 21 is connected to a plate 13, which is rigid with the star connection rod 9 and is raised from the latter by means of columns 14.

The output shaft 12 of the unit 11 is connected to the crank 10 by unidirectional driving means, which advantageously comprise a free wheel 15.

The latter is mounted about the output shaft 12 and is housed inside a suitable recess defined in the crank 10.

The table 3 is supported by the base 2 through bearings 16, so as to turn about an axis which coincides with the axis of the shaft 12, i.e. with the turning axis of the crank 10.

The star connecting rod 9 is coupled to the crankshafts 7, which project at the bottom from the related vessels 4, 5 by end portions, or by portions nearer to the center so as to allow to arrange, above the table 3, a high number of vessels 5 having their centers on two concentrical circumferences.

Near the periphery of the table 3 there are arranged metering-dispensing devices 17, for example plunger devices of a known type, each being connected to a respective vessel through a duct 18 so that the coloring substance held in the vessels 4 and 5 can be supplied, in a metered manner, depending on requirements.

The mixing apparatus according to the present invention operates as follows.

The coloring substances to be mixed are introduced into the vessels 4 and 5.

Then, the motor reducing unit 11 is actuated so as to rotate the crank 10 and, accordingly, the star connecting rod 9 about the axis of the output shaft 12 of said unit.

Thus, the connecting rod will define, by the center thereof, a circumference about the axis of the output shaft 12.

This motion of the star connecting rod will simultaneously operate all of the crankshafts 7 and, accordingly, all the mixing blades 6 provided in the related vessels 4 and 5.

After having achieved a desired mixing degree, the unit 11 is stopped and, by exploiting the rotary capability of the table 3 about the axis of the output shaft 12, owing to the provision of the bearing 16, it will be possible to bring one or more metering-delivering devices 17 to a related vessel, arranged under the table 3 and provided for receiving a metered amount of the coloring substances held in the vessels.

In particular, the table 3 can be rotated about the axis of the output shaft 12 either manually, or by an auxiliary motor, of any known types and not shown for simplicity, so as to cause the free wheel 15 to idly rotate with respect to the output shaft 12, so as not to further mix the coloring substances held in the vessels 4 and 5.

From the above disclosure and from an observation of the figures of the accompanying drawings, it should be apparent that the invention fully achieves the intended aim and objects.

In particular, the fact is to be pointed out that an apparatus has been provided which is adapted to simultaneously mix several liquid products, in particular coloring substances for paints and the like, held in several vessels, thereby providing a substantially homogeneous mixing inside said vessels.

The invention, as disclosed, is susceptible to several variations and modifications, all of which will come within the scope of the inventive idea.

Moreover, all the constructional details can be replaced by other technically equivalent elements.

In practicing the invention, the used materials, as well as their size, can be any, according to requirements.

I claim:

1. An apparatus for mixing liquid products, in particular for preparing coloring substances for paints and the like, said apparatus comprising a base supporting a substantially horizontal table, said table supporting on a top face thereof a plurality of vessels for the liquid products to be mixed, inside each said vessel a stirring element is arranged, each stirring element having a driving end portion projecting from said vessel, a coupling element being provided for coupling the driving end portions of said stirring elements to driving means which can be controllably actuated to drive said stirring elements, wherein said driving means comprises a motor reducing unit supported by said base under said table and coupled by an output shaft thereof to a crank.

2. The apparatus according to claim 1, wherein the driving end portion of each stirring element comprises a crankshaft rotatably supported about a substantially vertical axis of its related vessel and pivoted to said coupling element, said coupling element comprising a star connecting rod arranged on said table and pivoted at the center thereof to said crank which is rotatably driven about a vertical axis spaced from the center of said star connecting rod.

3. The apparatus according to claim 1, wherein said motor reducing unit output shaft is coupled to said crank through unidirectional transmission means.

4. The apparatus according to claim 3, wherein said unidirectional transmission means comprises a free wheel mounted about an output shaft and coupled inside said crank.

5. The apparatus according to claim 1, wherein said base includes means for rotatably supporting said table about a vertical axis coinciding with the rotary axis of said crank.

6. The apparatus according to claim 1, wherein said stirring elements each comprise a blade, coupled to that portion of the driving end portion of the related stirring element which vertically extends inside the related vessel.

7. The apparatus according to claim 1, wherein said vessels have a substantially cylindrical configuration and the driving end portions of the stirring elements comprise crankshafts arranged with the rotary axes thereof substantially coinciding with the axes of the related vessels.

8. The apparatus according to claim 1, wherein each said vessel is coupled to a metering-delivering device mounted at a peripheral portion of said table.

* * * * *